US007655851B2

(12) United States Patent
Nagakura

(10) Patent No.: US 7,655,851 B2
(45) Date of Patent: Feb. 2, 2010

(54) TUNING DEVICE OF WIRELESS COMMUNICATION TYPE

(75) Inventor: Fumiyoshi Nagakura, Chiba (JP)

(73) Assignee: Seiko Instruments Inc. (JP)

( * ) Notice: Subject to any disclaimer, the term of this patent is extended or adjusted under 35 U.S.C. 154(b) by 166 days.

(21) Appl. No.: 11/663,103

(22) PCT Filed: Oct. 14, 2005

(86) PCT No.: PCT/JP2005/018916

§ 371 (c)(1),
(2), (4) Date: Apr. 27, 2007

(87) PCT Pub. No.: WO2006/043469

PCT Pub. Date: Apr. 27, 2006

(65) Prior Publication Data

US 2008/0036915 A1 Feb. 14, 2008

(30) Foreign Application Priority Data

Oct. 20, 2004 (JP) ..... 2004-305400

(51) Int. Cl.
*G10D 1/08* (2006.01)

(52) U.S. Cl. ..... 84/312 R; 84/454

(58) Field of Classification Search ..... 84/312 R, 84/200, 477 R, 454
See application file for complete search history.

(56) References Cited

U.S. PATENT DOCUMENTS 6,278,047 B1 * 8/2001 Cumberland ..... 84/455
2004/0187673 A1 * 9/2004 Stevenson ..... 84/737

* cited by examiner

*Primary Examiner*—Jianchun Qin
(74) *Attorney, Agent, or Firm*—Adams & Wilks

(57) ABSTRACT

A tuning device has a sound collecting unit having an input section for receiving a sound or vibration signal produced by a musical instrument and outputting a sound signal, and a wireless communication section for converting the sound signal into a wireless signal and transmitting the wireless signal to the outside. A computation display unit has a receiving section for receiving the wireless signal transmitted from the sound collecting unit and converting the wireless signal into a sound signal, a computing section that computes pitch information based on the sound signal, computes an amount of difference between the pitch information and reference pitch information corresponding to a reference sound name, and converts the computation result into a control signal for display, and a display section for acquiring the control signal and displaying information concerning the amount of difference computed by the computing section.

6 Claims, 6 Drawing Sheets

FIG.6
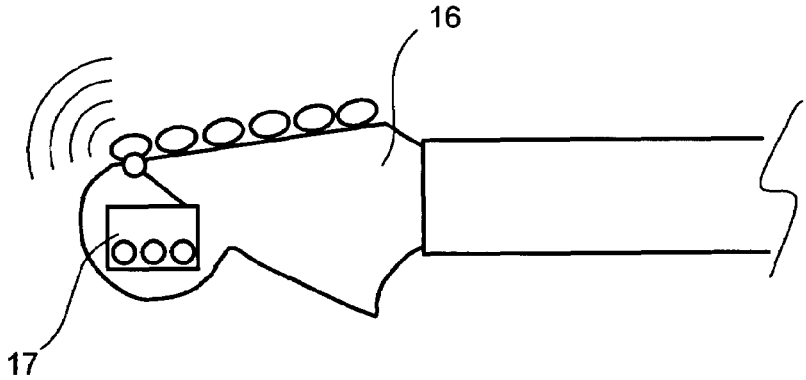
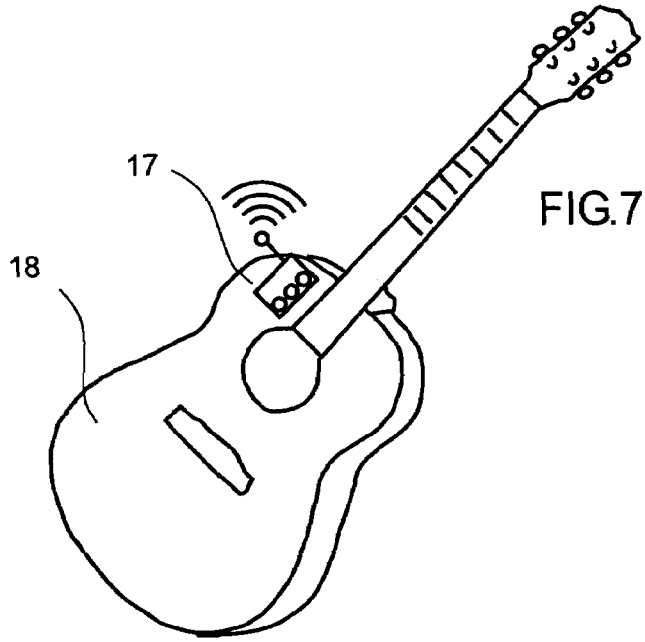
FIG.7
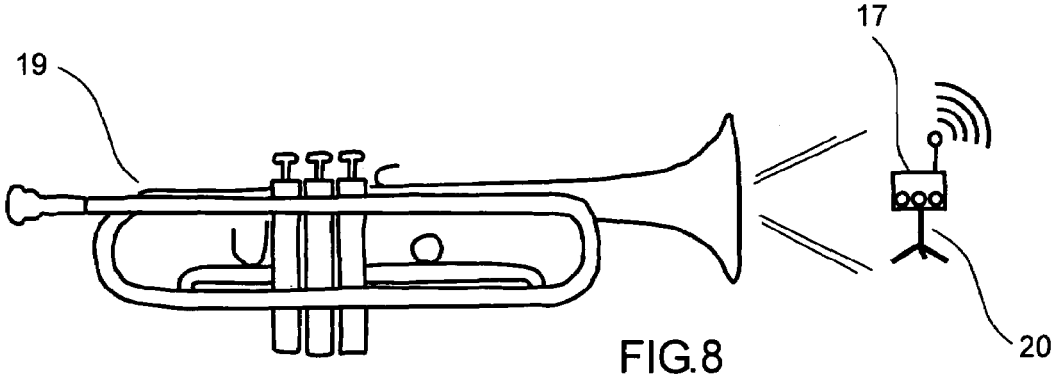
FIG.8

TUNING DEVICE OF WIRELESS COMMUNICATION TYPE

CROSS-REFERENCE TO RELATED APPLICATIONS

This application is a U.S. national stage application of International Application No. PCT/JP2005/018916, filed Oct. 14, 2005, claiming a priority date of Oct. 20, 2004, and published in a non-English language.

TECHNICAL FIELD

The present invention relates to a tuning device which is used for tuning a musical instrument.

BACKGROUND ART

In a case of tuning, for instance, an electric guitar using a conventional tuning device, such a method is widely used that a sound signal from the musical instrument is electrically and physically connected to the tuning device through a shielded cord. Also, in a case of tuning a musical instrument such as a wind instrument which does not have electric output, such a method is widely used that the tuning is performed using means such as a microphone built into a tuning device or a contact microphone with a built-in vibration sensor (see, for instance, Patent Document 1).

Patent Document 1: JP 2003-316352 A

In a case of tuning, for instance, an electric guitar using a conventional tuning device, it is required to input a sound signal from the musical instrument into the tuning device with a shielded cord, which means that there is inconvenience that it is required to reconnect the shielded cord each time tuning is performed. Some tuning devices have a bypass function without the need to reconnect such a shielded cord each time tuning is performed. When the bypass function is used, however, a sound signal from a musical instrument is adversely affected at the time of passage through a bypass circuit of the tuning device, which leads to a problem that an original sound inherent in the musical instrument is deteriorated.

Also, in a case of tuning a musical instrument such as a wind instrument which is incapable of outputting a sound signal as electric output, the tuning is performed using a built-in microphone or a contact microphone. When the built-in microphone is used, however, there arises a problem that, for instance, it becomes difficult to perform the tuning when a distance between the musical instrument and the built-in microphone is far or when a surrounding environment is noisy. Also, the contact microphone is ordinarily sold separately from a tuning device in many cases, so the use of the contact microphone increases an economic burden on a user and causes inconvenience that it is required to provide and set the contact microphone to the musical instrument and the tuning device each time tuning is performed.

Further, ordinarily, one person owns one tuning device in many cases but there is also a case where one tuning device is used by multiple persons. In this case, there is inconvenience that each time a musical instrument to be tuned is changed, it is required to reconnect the tuning device to the musical instrument.

Still further, when a user wants to change displaying or settings of a tuning device, it is necessary for the user to move closer to the tuning device to directly operate the tuning device and return to his/her original position to conduct tuning work.

Therefore, the present invention provides a tuning device that achieves improvement of workability of tuning by a user, visibility of tuning information, and tuning accuracy by separating a unit for collecting the sound of a musical instrument and a unit for displaying tuning information from each other. Also, the present invention provides a tuning device that also enables tuning of multiple musical instruments at the same time.

SUMMARY OF THE INVENTION

In order to solve the problems described above, a tuning device according to the present invention includes a sound collecting unit and a computation display unit. The sound collecting unit includes: an input section for receiving input of a signal of a sound or a vibration produced by a musical instrument and outputting a sound signal; and a wireless transmission section for converting the sound signal outputted from the input section into a wireless signal suited for transmission by wireless communication means and transmitting the wireless signal. The computation display unit includes: a receiving section for receiving the wireless signal transmitted from the sound collecting unit and converting or demodulating the wireless signal into a signal that is computable by a computation apparatus; a computing section for computing an amount of difference between a pitch extracted from the sound signal converted or demodulated by the receiving section and a corresponding reference pitch; and a display section for displaying the amount of difference outputted from the computing section.

Also, in the present invention, in addition to the input section and the wireless transmission section, the sound collecting unit includes: a parameter input section (first parameter input section) for inputting a parameter for computation of the sound signal inputted into the input section; and a computing section (parameter computing section) for computing the sound signal based on the parameter for computation and outputting a result thereof to the wireless transmission section. Here, this parameter computing section is also capable of converting the computation result into a control signal for causing the display section of the computation display unit to display the computation result, and the wireless transmission section is capable of transmitting this control signal.

Further, in the present invention, the computation display unit includes a parameter input section (second parameter input section) for inputting a parameter for computation of the sound signal converted or demodulated by the receiving section. The computing section of the computation display unit is capable of computing the sound signal based on this parameter for computation.

Still further, in the present invention, when the sound collecting unit computes the sound signal by itself and transmits a result of the computation to the computation display unit, it is possible for the computation display unit to convert the received computation result into displayable information and display the information with the display section. Also, when the sound collecting unit further creates a control signal for display from the computation result and transmits the control signal to the computation display unit, it is possible for the computation display unit to perform display concerning the computation result with the display section based on the control signal received.

Also, the tuning device according to the present invention is a tuning device in which the first and second parameter input sections are apparatuses that input computation conditions used when the amount of difference between the pitch of the sound signal and the reference pitch is computed.

Also, the tuning device according to the present invention is a tuning device including a mode selecting apparatus for selecting an operation mode in which the computation display unit operates.

Also, the tuning device according to the present invention is a tuning device in which one or multiple identification codes for identification of the sound collecting unit are included in the wireless signal, and the wireless transmission section transmits the wireless signal including the identification codes.

Also, the tuning device according to the present invention is a tuning device in which the computation display unit detects the identification code included in the wireless signal, determines the sound collecting unit with reference to data stored in advance so as to be associated with the identification code, and displays an identification number or symbol of the sound collecting unit with the display section.

Also, the present invention provides a pitch display method with which a sound signal concerning the sound or vibration produced by a musical instrument is transmitted as corresponding wireless transmission, the wireless signal is received at a position remote from the musical instrument, and a difference of the sound signal from a reference pitch is displayed.

That is, the tuning device according to the present invention includes a transmission apparatus and a reception apparatus that are capable of communicating data, such as a collected sound signal, a computation result obtained by computing the sound signal, and a control signal for display created from the computation result, using wireless communication means.

The tuning device according to the present invention includes at least one transmission apparatus and at least one reception apparatus (sound collecting unit and computation display unit) and there are three patterns. In a first pattern (1), the sound collecting unit collects a sound and the computation display unit computes the collected sound signal, creates a control signal for display, and displays a difference from a reference pitch. In a second pattern (2), the sound collecting unit collects a sound and computes the collected sound signal and the computation display unit receives a result of the computation, creates a control signal for display, and displays a difference from a reference pitch. In a third pattern (3), the sound collecting unit collects a sound, computes the collected sound signal, and creates a control signal for display from a result of the computation and the computation display unit receives the control signal and performs display in which a difference from a reference pitch is displayed. Here, in each of these three patterns, communication between the sound collecting unit and the computation display unit is performed using wireless communication means.

At least one transmission apparatus and at least one reception apparatus (at least one sound collecting unit and at least one computation display unit) perform transmission and reception as a pair. The numbers of the sound collecting units and the computation display units that are paired with each other may be different from each other. For instance, a construction is possible in which multiple sound collecting units are paired with one computation display unit.

Also, the tuning device according to the present invention may adopt a form including: an output apparatus for transmitting a sound signal transmitted and received by wireless communication and a result of computation by the computing section to an external device other than the tuning device according to the present invention; and an input apparatus for taking in information from an external device.

Further, it is also possible to use the sound collecting unit like a so-called remote control by providing a sound collecting unit with a display section and an operation section like a switch, which is used to change display contents, settings and the like of a computation display unit.

BRIEF DESCRIPTION OF THE DRAWINGS

FIG. 6 shows an attachment state of the sound collecting unit according to the embodiment of the present invention;

FIG. 7 shows an attachment state of the sound collecting unit according to the embodiment of the present invention;

FIG. 8 shows an attachment state of the sound collecting unit according to the embodiment of the present invention.

DETAILED DESCRIPTION OF THE INVENTION

Hereinafter, embodiments of the invention will be described with reference to the drawings.

Figure 1:
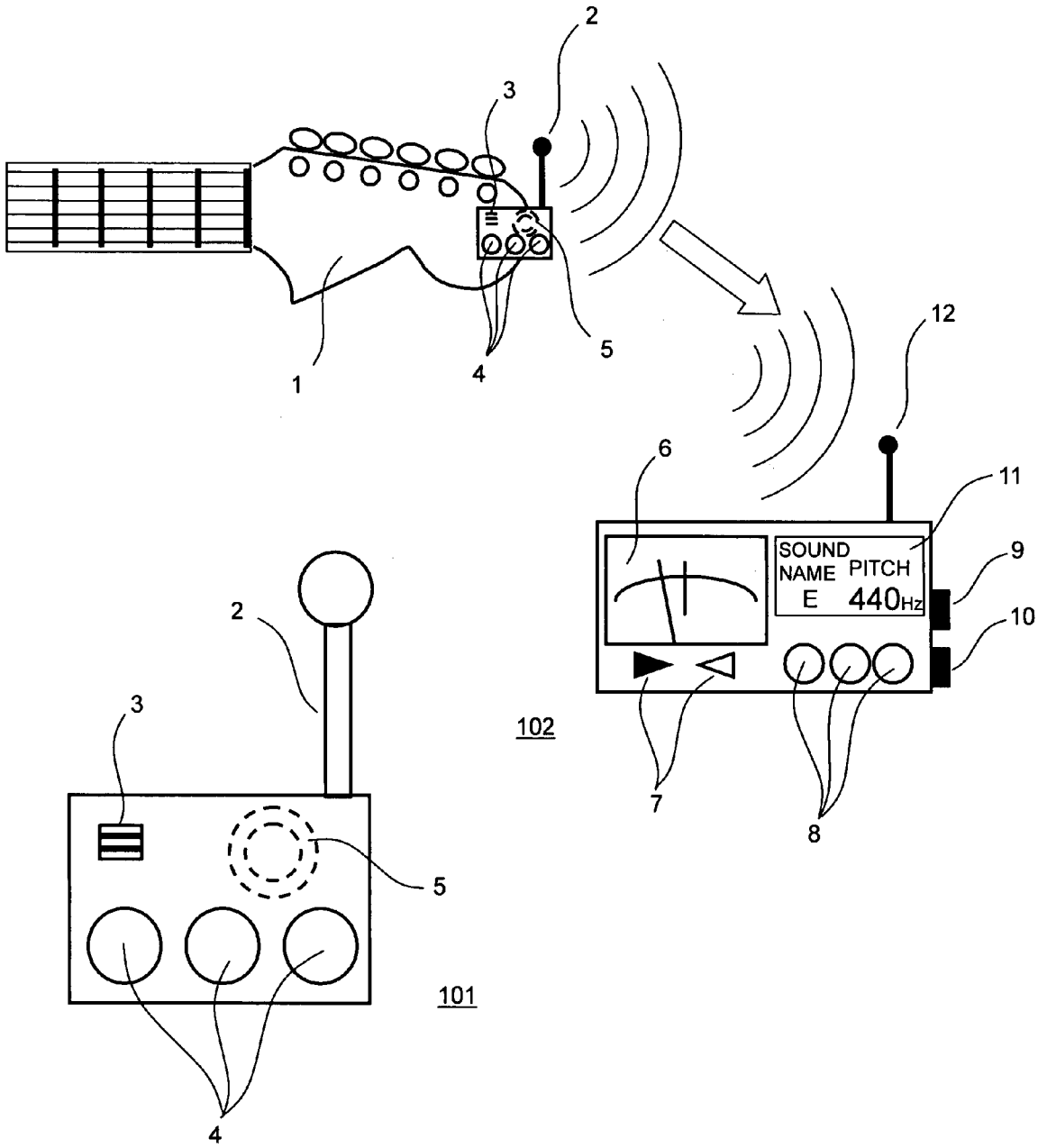
FIG. 1 is a schematic diagram showing a tuning device of wireless type using radio waves according to an embodiment of the present invention.

In FIG. 1, a sound collecting unit 101 is directly or indirectly attached to, for instance, a head 1 of an electric guitar, converts the sound or vibration produced by the musical instrument into a wirelessly communicable signal through conversion into an electric signal (sound signal) with a microphone 3 or a vibration sensor 5, and outputs the signal as a wireless communication signal from an antenna 2.

In general, a nondirectional electret capacitor microphone that is compact and inexpensive is used as the microphone but any other microphone, such as a dynamic microphone, is also usable so long as it is possible to collect the sound with the microphone.

In general, a piezoelectric element that is thin and inexpensive is used as the vibration sensor but any other element, such as a gyroscopic sensor; is also usable so long as it is possible to detect the vibration with the element.

There is no limitation on the kind of the wireless communication signal outputted from the antenna 2 so long as it is possible for wireless communication means by radio waves, such as FM radio waves, AM radio waves, or Bluetooth radio waves, to process the wireless communication signal.

Figure 3:
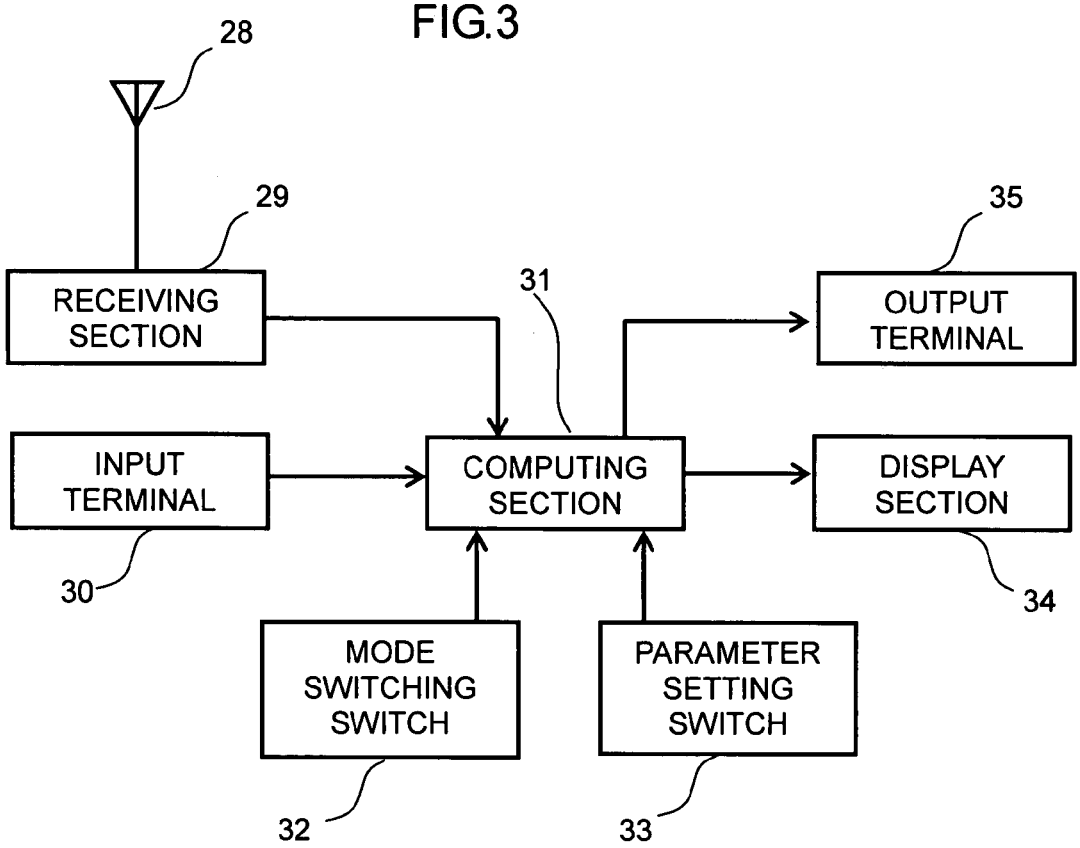
FIG. 3 is a block diagram showing a computation display unit according to the embodiment of the present invention.

The wireless communication signal outputted from the antenna 2 is received by an antenna 12 of a computation display unit 102, is demodulated into a signal that a computing section 31 is capable of computing by a receiving section 29 as shown in FIG. 3, and is computation-processed by the computing section 31.

An amount of difference from a reference pitch that is a result of the computation by the computing section 31 shown in FIG. 3 is displayed by a display section 6.

Parameter setting switches 4 of the sound collecting unit 101 make a setting of parameters for computation of the sound signal. As examples of the parameters of this case, there are values concerning shift amounts in a pitch shift setting (setting of a degree of a Hz shift from the reference pitch at which tuning is performed), a transposition setting (setting of a degree of a sound shift from a reference sound at which tuning is performed), and the like. Also, as to the parameter setting switches 4, when installation is difficult due to a reason concerning a final product size or the like or when the number of the parameters is increased or decreased according to product specification, the number of the parameter setting switches maybe increased or decreased to an appropriate number or, alternatively, all of the parameter setting switches may be removed.

The meter 6 of the computation display unit 102 displays the difference from the reference pitch. It is general that a needle type meter having a pointer is used as a display method but any other method, such as a method of using a pseudo needle type meter displayed using a liquid crystal display or one or multiple LEDs, is also usable so long as a notification showing the difference from the reference pitch is issued to a user.

A tuning guide 7 visually aids the display by the meter 6, and a system in which when an inputted signal is lower than the reference pitch, a left side is lit up and when the inputted signal is higher than the reference pitch, a right side is lit up, is illustrated as an example. As shown in the figure, the tuning guide 7 includes at least two display bodies. A construction is also possible in which the tuning guide 7 includes five display bodies in total, with two display bodies being provided on the left side, two display bodies being provided on the right side, and one display body being provided on the center, for instance. Also, in FIG. 1, the parameters are displayed by a parameter display section 11, but the number of the display bodies of the tuning guide 7 is appropriately increased or decreased to give the tuning guide 7 a duplicate function of, for instance, displaying the pitch shift parameter, thereby making it possible to effectively use a limited display space.

Switches 8 are used to make a setting of the parameters displayed on the parameter display section 11. The parameters of this case are parameters mainly concerning the pitch shift setting, the transposition setting, and the operation mode setting.

An input terminal 10 has the same function as that of an input terminal provided for a conventional tuning device and is connectable with a musical instrument, such as an electric guitar, which has an electric output terminal.

An output terminal 9 has a function of subjecting an input signal from the input terminal 10 to throughout. In addition, it is also possible to demodulate a wireless communication signal transmitted from the sound collecting unit and output the demodulated signal to another device from the output terminal 9. It is possible for a user to arbitrarily select one of those output manners.

Figure 2:
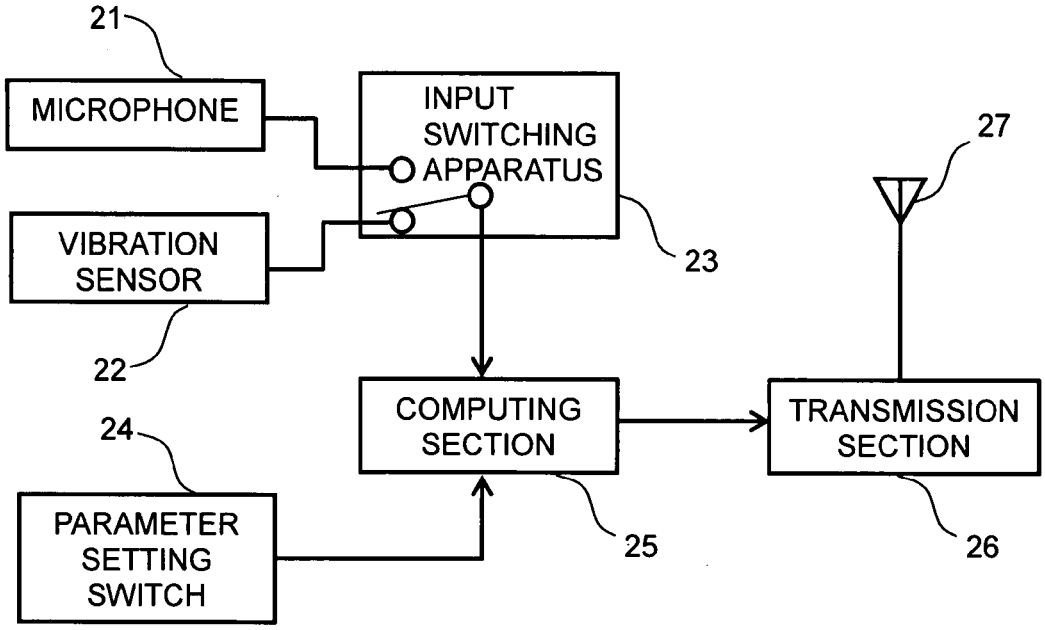
FIG. 2 is a block diagram showing a sound collecting unit according to the embodiment of the present invention.

FIG. 2 is a block diagram showing an example of a construction of the sound collecting unit 101 according to the embodiment of the present invention. In FIG. 2, the sound collecting unit 101 takes in the sound or vibration produced by a musical instrument or the like by converting the sound or vibration into an electric signal with a microphone 21 or a vibration sensor 22. The microphone and the vibration sensor are used as means for taking in the sound or vibration, and it is possible for a user to arbitrarily select one of the microphone and the vibration sensor. Then, the electric signal from the selected one of the microphone and the vibration sensor is inputted into a computing section 25.

The computing section 25 provided for the sound collecting unit 101 extracts pitch information from a sound signal converted into the inputted electric signal, performs coding, and outputs a result of the coding to a transmission section 26. The computing-section 25 is also capable of computing an amount of difference from a reference pitch or the like using parameters inputted with a parameter setting switch 24 to be described later. In addition, the computing section 25 is also capable of creating a control signal for display from the result of the computation.

Figure 9:
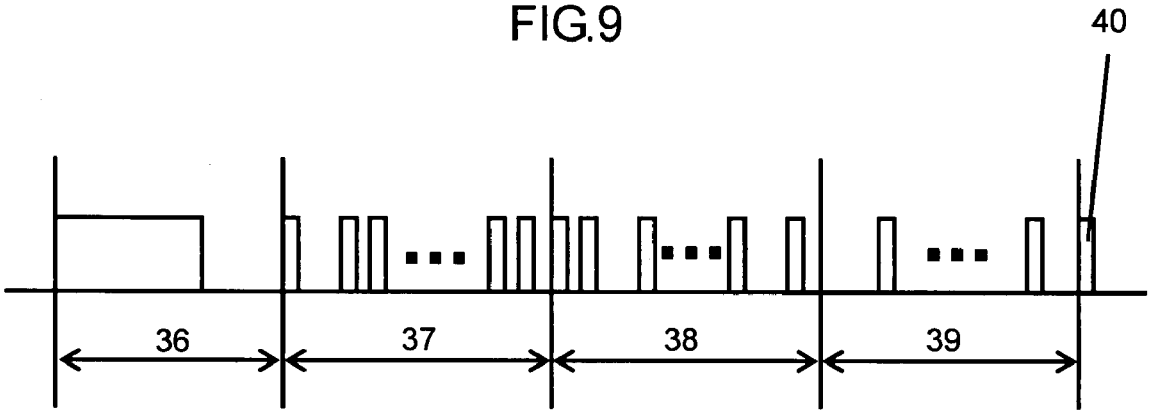
FIG. 9 shows an example of a transmission code in the case of infrared rays communication according to the embodiment of the present invention.

FIG. 9 shows an example of coding in the case where infrared rays communication has been selected as wireless communication means. A system of this data communication is based on a so-called NEC format that is a data format for remote control provided by NEC Electronics Corporation. A code group including a reader code 36, a 16-bit custom code 37, an 8-bit data code 38, an 8-bit inverse data code 39 obtained by inverting the data code 38, and a stop bit 40 is transmitted as one frame.

The reader code 36 indicates start of the frame. For instance, a Hi state of the reader code 36 continues for a period of T (ms) and then a Lo state of the reader code 36 continues for T/2 (ms). Through detection of a difference between duration times of Hi and Lo, the reader code 36 is detected.

The custom code 37 is a code for identification of a corresponding contact microphone of the tuning device. With the custom code 37, confusion in a case where multiple sound collecting units are used at the same time is prevented.

The data code 38 and the inverse data code 39 are main body portions of data transmitted. After the data code 38 has been received, the inverse data code 39 is received and it is verified whether there exists any data difference between these codes. In this case, it is preferable that a duty ratio is set to 1/3.

The stop bit 40 indicates end of the one frame of the data. When the bit is received, the transmission of the one frame is ended.

The data format is not limited to the format described above and it is preferable that the data format is changed as appropriate in accordance with a specification of data communicated, hardware, or the like as occasion demands.

Referring again to FIG. 2, when an FM communication system is selected as the communication means, for instance, the transmission section 26 performs modulation to thereby enable FM transmission of the inputted computation result or the like. Then, the transmission section 26 sends out a result of the modulation from an antenna 27 by radio waves.

The computation by the computing section 25 is carried out through selection and use of the parameters set by the parameter setting switch 24 for the pitch shift setting, the mode setting, and the like.

FIG. 3 is a block diagram showing an example of a construction of the computation display unit according to the embodiment of the present invention. Radio waves sent out from the antenna 27 of the sound collecting unit of FIG. 2 are received by an antenna 28 installed at a remote position and a received signal is demodulated by a receiving section 29 into a signal that a computing section 31 is capable of computing.

An input terminal 30 is a terminal for taking in an input signal from the outside like a terminal provided for a conventional tuning device and is capable of receiving input from a musical instrument such as an electric guitar, which is capable of performing electric output.

A mode switching switch 32 is capable of making a setting of a tuning mode or the like.

A parameter setting switch 33 is capable of setting parameters, such as a reference pitch, which are necessary for tuning.

The computing section 31 performs computation on input signals from the receiving section 29 and the input terminal 30, calculates an amount of difference from the reference pitch, creates a control signal for display, and outputs the control signal to a display section 34. Also, the computing section 31 performs computation corresponding to input signals from the mode switching switch 32 and the parameter setting switch 33 at the time of performing the computation on the input signals from the receiving section 29 and the input terminal 30. A result of the computation by the computing section 31 is outputted to the display section 34 or an output terminal 35. Further, the computing section 31 is capable of, when the sound collecting unit 101 receives a computation result that is a result of computation performed by itself, converting the computation result into a control signal for display and sending out the control signal to the display section 34.

The display section 34 acquires the control signal for display from the computing section 31 or the sound collecting unit 101 and displays the computed amount of difference from the reference pitch with the needle type meter, the pseudo meter of an LED type, or the like. In addition, contents set by the mode switching switch 32 and the parameter setting switch 33 are also displayed on the display section 34. As a display method, there are a liquid crystal display, LEDs, and the like. The output terminal 35 performs output to an external device. For instance, the output terminal 35 has a function of outputting the result of the computation by the computing section 31, a function of outputting the sound signal demodulated by the receiving section 29 through the computing section 31, and a function of subjecting a signal inputted from the input terminal 30 to throughout. It is preferable that it is possible to arbitrarily select those functions in accordance with a product specification.

It should be noted here that in FIGS. 2 and 3, the sound collecting unit 101 and the computation display unit 102 respectively include the parameter setting switches 24 and 33 but only one of these apparatuses may include the parameter setting switch and the computation of the sound signal using the parameters may be performed at only one of the apparatuses.

Next, another embodiment of the present invention will be described.

Figure 4:
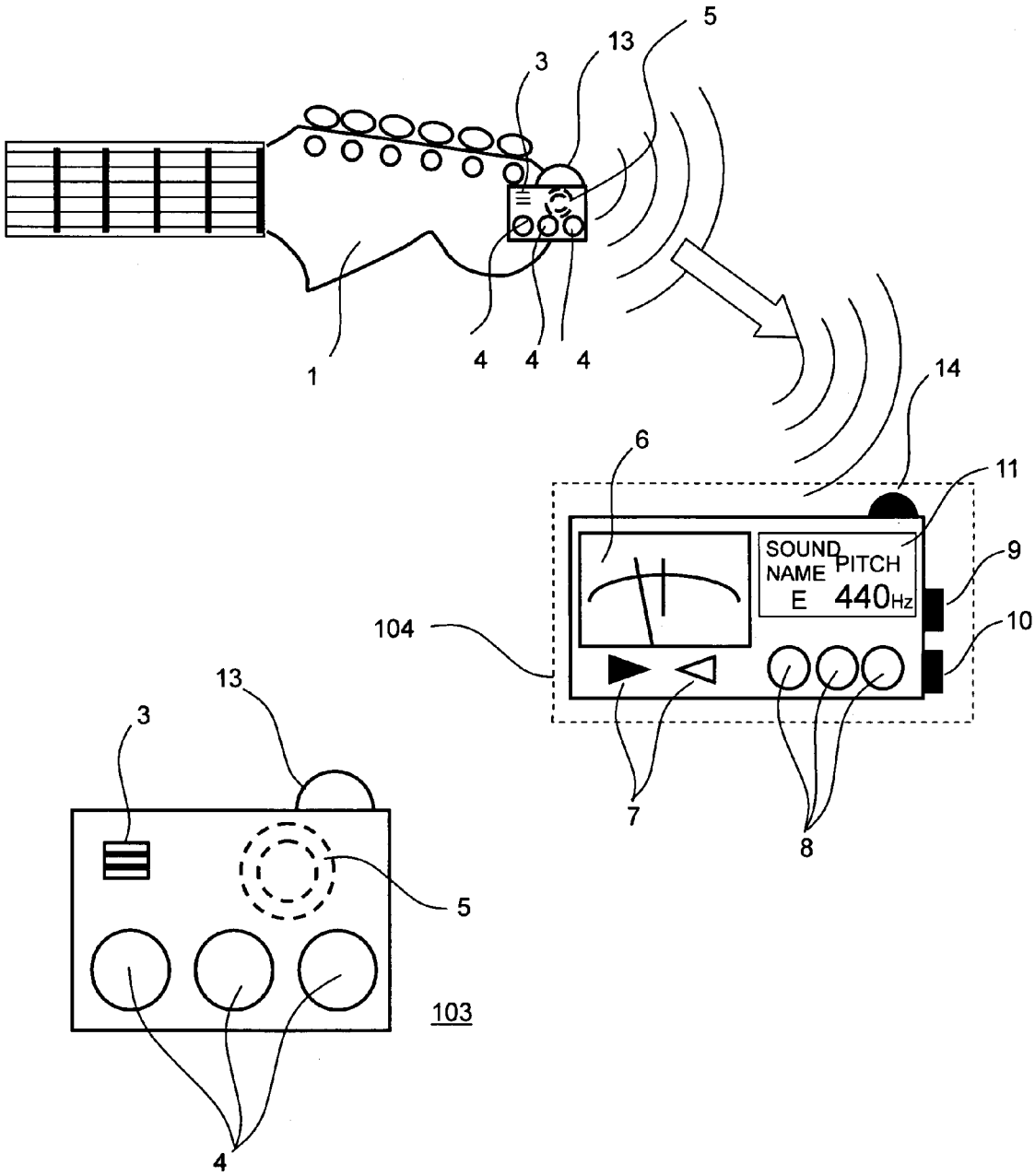
FIG. 4 is a schematic diagram showing a tuning device of wireless type using infrared rays in an embodiment of the present invention.

In FIG. 4, an infrared rays communication apparatus 13 is provided for a sound collecting unit 103 and an infrared rays communication apparatus 14 is provided for a computation display unit 104. With these paired infrared rays communication apparatuses, the sound collecting unit 103 and the computation display unit 104 perform wireless communication. Note that it is most preferable that the infrared rays communication apparatus 13 and the infrared rays communication apparatus 14 are installed in a position relation in which these apparatuses oppose each other, but when such installation is difficult due to a limitation resulting from a product design or the like, it is sufficient that the apparatuses are installed at sites close to opposing one another.

Figure 5:
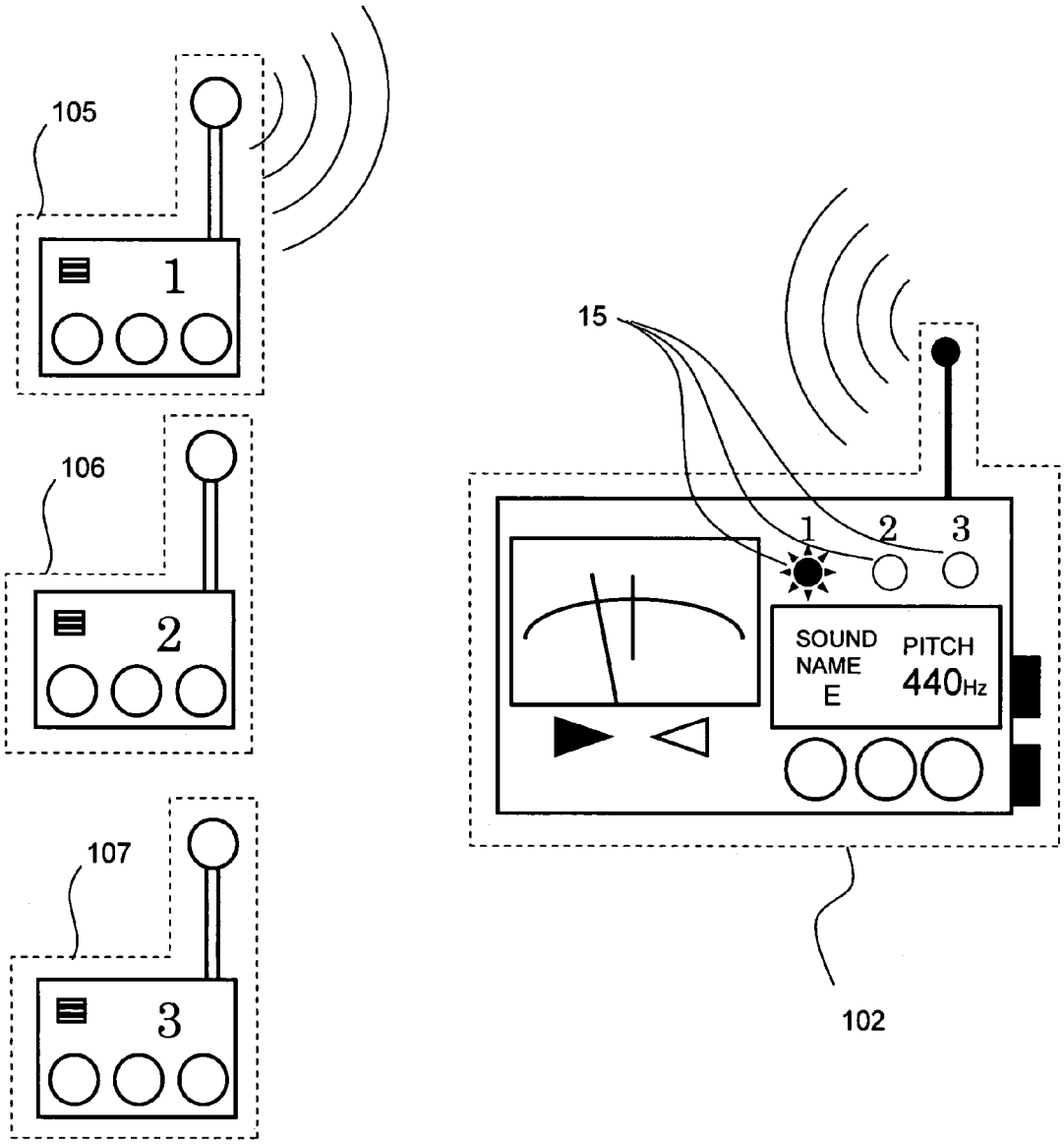
FIG. 5 shows a system of a tuning device showing another embodiment of the present invention.

FIG. 5 shows an example of a state in which multiple sound collecting units 105, 106, and 107 and one computation display unit 102 communicate with each other. When receiving a wireless communication signal sent out from one of the sound collecting units 105,106, and 107, the computation display unit 102 automatically identifies the sound collecting unit, which has sent out the wireless communication signal, with reference to an identification code included in the wireless communication signal and displays the identified sound collecting unit on a reception display section 15.

As shown in the figure, the reception display section 15 performs the display by lighting up an LED having an individual number assigned to the corresponding sound collecting unit. As a method for the display by the reception display section 15, aside from the illustrated display method using LEDs, there is also a method with which the display is performed using a 7-segment LED, for instance. This method is suited for a case where the device is frequently used in a dark place or a case where high visibility is required. Also, in the case of display by the parameter display section 11, a liquid crystal display or the like is used so as to reduce power consumption, so a low power consumption device is suitably used. It is preferable that an optimum display method is selected in accordance with an imaginable use scene or specification in this manner.

Wireless communication signals are demodulated by the receiving section 29 illustrated in FIG. 3, the demodulated signals are processed by the computing section 31, and differences with the reference pitch are displayed by the meter 6. In this case, the wireless communication signals sent out from the sound collecting units 105, 106, and 107 include codes with which it is possible to identify the sound collecting units that have sent out the wireless communication signals. The computation display unit 102 reads the codes, determines the sound collecting units that have sent out the signals, and displays the determined sound collecting units on the reception display section 15. Also, in this embodiment, the sound collecting units that have sent out the signals are automatically determined but a user may select a sound collecting unit from which the user wants to receive the signal, and may manually make switching to the sound collecting unit using a switch or the like.

FIGS. 6 to 8 each show an example of attachment and installation of the sound collecting unit. FIG. 6 is characterized in that a sound collecting unit 17 is attached to a back surface of a guitar head 16, thereby preventing the sound collecting unit 17 from being viewed by an audience in the case of use thereof in a concert or the like. As an attachment method, there are a method using a clip, a method using an adhesive, a method using an attachment member, a method based on screw fixation, and the like.

FIG. 7 shows an example in which the sound collecting unit is attached to a folk guitar. By attaching the sound collecting unit to a body of the folk guitar, it becomes possible to increase efficiency of collection of a sound signal by the vibration sensor. As an attachment method, there are a method using a clip, a method using an adhesive, a method using an attachment member, a method based on screw fixation, and the like. Also, an attachment position is not limited to a position shown in FIG. 7 and the sound collecting unit may be attached to a side surface, a back surface, neck, or head of the guitar or may be installed in a body of the guitar or the like.

FIG. 8 shows an example of a method with which, for example, the sound collecting unit is installed at a position remote from a musical instrument using a stand 20 and a sound signal is collected with the microphone, in a case of using a wind instrument such as a trumpet, when it is difficult to directly attach the sound collecting unit to the musical instrument unlike in the case of a guitar.

By adding the communication function of the present invention to a tuning device in the manner described above, a shielded cable that has been required at the time of tuning of an electric guitar or the like becomes unnecessary, which makes it possible to reduce the amount of baggage.

Also, particularly in the case of an electric guitar, a tuning device is installed so as to be inserted into connection between the guitar and an amplifier, and a signal from the guitar is subjected to throughout and is sent to the amplifier. Therefore, there is a case where a so-called sound attenuation phenomenon occurs in which at the time of the throughout, the signal is adversely affected by an electric circuit of the tuning device and an original sound that the musical instrument has changes. In the present invention, physical and electric connection is not established between the musical instrument and the tuning device, so there is no possibility to cause the sound attenuation phenomenon.

Further, when an electric guitar is tuned with a conventional tuning device, there is inconvenience that the tuning is possible only within a reaching range of a shielded cord that is used to connect the electric guitar and the tuning device. In the present invention, however, wireless communication is used, so it becomes possible to solve this problem.

Further, in the present invention, it is possible to provide the computing section only for the computation display unit without providing the computing section for the sound collecting unit, so it becomes possible to reduce the size and weight of the sound collecting unit. As a result, even when the sound collecting unit is attached to a musical instrument, it becomes possible for a user to perform the musical instrument without feeling that something is wrong due to the weight of the sound collecting unit. In addition, a construction is also possible in which, conversely, the computing section is not provided on a display section side, which makes it possible to reduce the size and weight of the display section and increase portability. For instance, it also becomes possible to use the display section like a wristwatch by fitting it to a body. In either case, in the present invention, the apparatus that collect sounds of a musical instrument and the apparatus that displays tuning information are separated from each other, so it becomes possible to achieve improvement of workability of tuning by a user, visibility of tuning information, and tuning accuracy.

Also, when, for instance, the present invention is constituted of the sound collecting unit and the computation display unit with multiple sound collecting units and one computation display unit, it becomes possible for multiple persons to possess their own sound collecting units and share one computation display unit. With such a construction, it becomes unnecessary for each person to carry one tuning device unlike in a conventional case and it becomes possible to reduce an economic burden on the user. Also, in a group in which one tuning device is shared, it becomes unnecessary to reconnect the tuning device each time tuning is performed and it becomes possible for everyone in the group to conduct tuning work with efficiency merely by placing the display section at an easy-to-view place.

Also, in the present invention, it is possible to output signals collected by the sound collecting unit from the output terminal of the computation display unit. This function corresponds to a throughout function provided for a conventional general tuning device. However, in the case of the conventional tuning device, physical connection is established using a shielded cord or the like but in the present invention, wireless communication is used, so the shielded cord or the like becomes unnecessary.

Also, in the present invention, by providing an operation switch for the sound collecting unit, for instance, it becomes possible to set and change parameters and modes of the computation display unit in a so-called remote control manner using a wireless communication function. Therefore, it becomes possible to eliminate inconvenience that, in the case of making a device setting that is suitable for a conventional tuning device, a user needs to set and change parameters and modes by directly operating a switch or the like of the tuning device existing at a remote position.

Also, in the present invention, in order to perform wireless communication, modulation of a sound signal into a wirelessly communicable signal is performed. In this case, it is the most ideal that the modulation is performed without deforming the waveform of the collected sound signals but the present invention relates to a tuning device, so it is not required to faithfully reproduce an original sound, that is, the collected sound signals at the time of demodulating the wireless signal unlike in the case of a wireless microphone or the like, and it is sufficient that at least a pitch extracted from the sound signal is not changed. Therefore, there arises no problem even when a rectangular wave is modulated and transmitted, for instance. As a result, it becomes possible to simplify a wireless communication signal modulation apparatus and a wireless communication signal demodulation apparatus provided for a wireless transmitter and a wireless receiver, which makes it possible to reduce a manufacturing cost.

It should be noted that in this embodiment, an example in which the sound collecting unit is attached to a guitar or a wind instrument is particularly described, but the musical instrument to which the sound collecting unit can be attached is not limited to these instruments. The tuning device according to the present invention is usable also for any other musical instrument so long as the musical instrument requires tuning.

That is, the pitch display method according to the present invention with which "a sound signal concerning the sound or vibration produced by a musical instrument is acquired, information concerning the sound signal is transmitted as a wireless signal, the wireless signal is received and converted into the information concerning the sound signal, and information (pitch information) concerning tuning is displayed based on the information" is adoptable in any tuning device used for any musical instrument.

INDUSTRIAL APPLICABILITY

The present invention is applicable to a tuning device of a wireless communication type with which it becomes possible to confirm tuning information concerning the sound or vibration produced by a musical instrument at a place remote from the musical instrument without being limited by wiring of a shielded cord or the like.

The invention claimed is:

1. A tuning device of wireless communication type, comprising:

a sound collecting unit including an input section for receiving a signal of a sound or a vibration produced by a musical instrument and outputting a sound signal; a parameter computing section for computing pitch information based on the sound signal acquired from the input section and computing an amount of difference between the pitch information and reference pitch information corresponding to a reference sound; and a wireless communication section for converting a result of the computation acquired from the parameter computing section into a wireless signal and transmitting the wireless signal to the outside, wherein the sound collecting unit stores an identification code for identification of itself, and the wireless communication section includes the identification code of itself in the wireless signal and transmits the wireless signal including the identification code to the outside; and a computation display unit including a receiving section for receiving the wireless signal transmitted from the sound collecting unit and converting the wireless signal into the computation result; a computing section for converting the computation result acquired from the receiving section into a control signal for display; and a display section for acquiring the control signal and displaying information concerning the amount of difference computed by the parameter computing section, wherein the computation display unit stores the identification code of the sound collecting unit in advance, and the computing section determines the sound collecting unit that transmitted the wireless signal by comparing the identification code included in the wireless signal and the stored identification code.

2. A tuning device of wireless communication type according to claim 1, wherein the sound collecting unit further includes a first parameter input section for inputting a parameter for computation that is used for computing the sound signal, and wherein the parameter computing section computes the pitch information from the sound signal based on the parameter for computation inputted from the first parameter input section, and computes the amount of difference between the pitch information and the reference pitch information corresponding to the reference sound name.

3. A tuning device of wireless communication type according to claim 2, wherein the first parameter input section is an apparatus for inputting a condition at the time of the computation of the amount of difference from the reference pitch.

4. A tuning device of wireless communication type according to claim 2, wherein the parameter for computation is a parameter concerning a pitch shift setting or a transposition setting.

5. A tuning device of wireless communication type according to claim 1, wherein the computation display unit further includes a mode selecting section for selecting an operation mode of the tuning device of wireless communication type.

6. A tuning device of wireless communication type according to claim 1, wherein the display section acquires information concerning the determined sound collecting unit from the computing section and displays the determined sound collecting unit in an identifiable manner based on the information.

* * * * *